US008650899B2

(12) United States Patent
Lee

(10) Patent No.: US 8,650,899 B2
(45) Date of Patent: Feb. 18, 2014

(54) POWER TRANSMISSION ASSEMBLY AND ICE-MAKING ASSEMBLY USING THE SAME

(75) Inventor: Byoung-Jun Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 899 days.

(21) Appl. No.: 12/673,120

(22) PCT Filed: Sep. 1, 2008

(86) PCT No.: PCT/KR2008/005134
§ 371 (c)(1),
(2), (4) Date: Feb. 11, 2010

(87) PCT Pub. No.: WO2009/035228
PCT Pub. Date: Mar. 19, 2009

(65) Prior Publication Data

US 2012/0023995 A1 Feb. 2, 2012

(30) Foreign Application Priority Data

Sep. 13, 2007 (KR) ..... 10-2007-0093327

(51) Int. Cl.
*F25C 1/22* (2006.01)

(52) U.S. Cl.
USPC ..... 62/340

(58) Field of Classification Search
USPC ..... 249/66.1, 69, 70, 119, 127, 137; 425/440; 62/72; 74/457, 459.5
See application file for complete search history.

(56) References Cited

U.S. PATENT DOCUMENTS

| | | | | | |
|---|---|---|---|---|---|
| 274,862 | A * | 3/1883 | Vivarttas | 74/459.5 |
| 3,712,076 | A * | 1/1973 | Fox | 62/137 |
| 3,745,779 | A * | 7/1973 | Bright | 62/135 |
| 4,500,780 | A * | 2/1985 | Buan et al. | 250/231.13 |
| 5,970,725 | A * | 10/1999 | Lee | 62/137 |
| 7,841,203 | B2 * | 11/2010 | Yoon et al. | 62/344 |
| 2001/0008860 | A1 | 7/2001 | Niimi et al. | |
| 2006/0032262 | A1 * | 2/2006 | Seo et al. | 62/340 |
| 2007/0151282 | A1 | 7/2007 | Jeong et al. | |

FOREIGN PATENT DOCUMENTS

| | | | |
|---|---|---|---|
| JP | 6-94102 | A | 4/1994 |
| JP | 2001-200898 | A | 7/2001 |
| KR | 2001-0011512 | A | 2/2001 |
| KR | 10-2007-0064207 | A | 6/2007 |

* cited by examiner

*Primary Examiner* — Melvin Jones
(74) *Attorney, Agent, or Firm* — Birch, Stewart, Kolasc & Birch, LLP

(57) ABSTRACT

An ice-making assembly for a refrigerator, which can effectively separate ice from a tray and a power transmission assembly for transmitting power to the tray are provided. The power transmission assembly includes a body unit defining an exterior of the ice-making assembly and a plurality of gear teeth protruding from an outer circumference of the body unit. Each of the gear teeth includes a first end portion protruding from the body unit by a predetermined distance and a second end portion further protruding from the body unit than the first end portion. According to the embodiments, even when the water is infiltrated into the power transmission assembly and frozen, the frozen ice can be removed in a direction by the above-described structures of the gears.

13 Claims, 2 Drawing Sheets

POWER TRANSMISSION ASSEMBLY AND ICE-MAKING ASSEMBLY USING THE SAME

TECHNICAL FIELD

The present disclosure relates to an ice-making assembly for a refrigerator.

BACKGROUND ART

Generally, an ice-making assembly for making ice is installed in one of a main body of the refrigerator or a door of the refrigerator to make ice using cooling air.

The ice-making assembly includes an outer case defining an exterior thereof, an ice-making unit provided in the outer case, a water tank for storing water that will be supplied to the ice-making unit, and an ice bank for storing the ice made by the ice-making unit. The ice bank is received in the outer case to be capable of going in and out of the outer case.

The ice-making assembly further includes a tray in which the water is frozen and an ice-separating unit that is connected to the tray to separate the ice made in the tray from the tray.

The ice-separating unit includes a lever that is designed to rotate by a user and a power transmission assembly for transmitting rotational force of the lever to the tray.

When the user intends to use the ice made in the tray, the user rotates the lever.

Then, the tray connected to the power transmission assembly is twisted while rotating so that the ice made in the tray is separated. The ice falls into the ice bank.

Subsequently, the user withdraws the ice bank frontward to use the ice stored in the ice bank.

Meanwhile, as the process for separating the ice from the tray is repeated, moisture is infiltrated into the power transmission assembly.

When the infiltrated moisture is frozen, the power transmission assembly may not normally work due to the frozen ice.

Accordingly, the user has to excessively apply force to the lever to operate the power transmission assembly.

This may cause the damage of the lever.

DISCLOSURE OF INVENTION

Technical Problem

Embodiments provide an ice-making assembly for a refrigerator, which can effectively separate ice from a tray by improving a power transmission assembly for transmitting power to the tray.

Embodiments also provide an ice-making assembly for a refrigerator, which is designed to easily remove ice formed in a power transmission assembly.

Embodiments also provide an ice-making assembly for a refrigerator, which is designed such that a user can easily rotate a lever.

Technical Solution

In an embodiment, a power transmission assembly for an ice-making assembly of a refrigerator, includes: a body unit defining an exterior of the ice-making assembly; and a plurality of gear teeth protruding from an outer circumference of the body unit, wherein each of the gear teeth includes a first end portion protruding from the body unit by a predetermined distance and a second end portion further protruding from the body unit than the first end portion.

In another embodiment, a power transmission assembly for an ice-making assembly of a refrigerator, includes: a body unit defining an exterior and including front and rear surface portions; and a plurality of gear teeth each provided with a protrusion extending from an outer circumference of the body unit, wherein the protrusion includes: a lower end portion formed on a side of the front surface portion; and an upper end portion formed on a side of the rear surface portion, wherein a distance between the protrusions at the lower end portion is greater than that at the upper end portion.

In still another embodiment, an ice-making assembly for a refrigerator includes: at least one tray in which water is frozen to ice; a manipulation unit for twisting the tray; and a gear assembly having a plurality of gears to transfer torque generated by the manipulation unit to the tray, wherein each of the gears includes: a rotating body unit; and a plurality of gear teeth protruding from the body unit, wherein a lower end portion of each of the gear teeth further protrudes than an upper end portion of each of the gear teeth.

Advantageous Effects

According to the embodiments, even when the water is infiltrated into the power transmission assembly and frozen, the frozen ice can be removed in a direction by the above-described structures of the gears.

Likewise, even when the foreign substances are inserted into the power transmission assembly to conflict with the gear teeth, the foreign substances can be removed in a direction by the above-described structures of the gears.

As the foreign substances or frozen ice can be removed from the power transmission assembly, the power transmission assembly can be more smoothly rotated.

Further, as the power transmission assembly can effectively operate, the lever for providing torque to the power transmission assembly can be easily manipulated.

As a result, the user can more conveniently use the ice-making assembly and thus the satisfaction of the user can be enhanced.

The details of one or more embodiments are set forth in the accompanying drawings and the description below. Other features will be apparent from the description and drawings, and from the claims.

BEST MODE FOR CARRYING OUT THE INVENTION

Reference will now be made in detail to the embodiments of the present disclosure, examples of which are illustrated in the accompanying drawings. It should be understood that numerous other modifications and embodiments can be devised by those skilled in the art that will fall within the spirit and scope of the principles of this disclosure.

Figure 1:
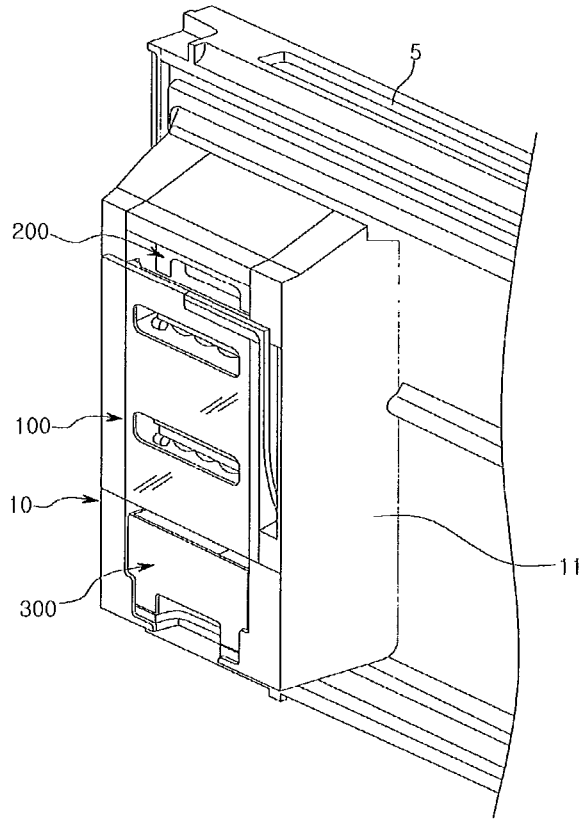
FIG. 1 is a perspective view of an ice-making assembly for a refrigerator according to an embodiment.

FIG. 1 is a perspective view of an ice-making assembly for a refrigerator according to an embodiment.

Referring to FIG. 1, an ice-making assembly 10 according to an embodiment is installed at an inside of a refrigerator door 5.

At this point, in order to more effectively make the ice in the ice-making assembly 10, the refrigerator door 5 may be a freezing compartment door. However, if an additional unit for supplying cool air to the ice-making assembly is provided, the ice-making assembly 10 may be provided in a refrigerating door.

In more detail, the ice-making assembly 10 includes a case 11 defining an exterior thereof, an ice-making unit 100 disposed in the outer case 11, a water tank 200 that is provided above the ice-making unit 100 to store the water that will be supplied to the ice-making unit 100, and an ice bank 300 that is provided under the ice-making unit 100 to store ice made by the ice-making unit 100.

The water tank 200 and the ice bank 300 are detachably coupled to the ice-making assembly 10. The user can detach the water tank 200 and fills the water tank 200 with the water. The user also can detach the ice bank 300 to take the ice store in the ice bank.

Alternatively, the water tank 200 may be connected to an external water source so that the water can be automatically supplied to the water tank 200.

The operation of the ice-making assembly 10 will be briefly described hereinafter.

In order to make the ice, the user fills the water tank 200 with water. Subsequently, the water tank 200 filled with the water is coupled to the ice-making assembly 10. Then, the water stored in the water tank 200 is supplied to the ice-making unit 100 through a predetermined water passage.

The water supplied to the ice-making unit 100 is frozen by cooling air introduced into the ice-making unit 100. When the ice is made in the ice-making assembly 100, the user makes the ice in the ice-making unit 100 stored in the ice bank 300. Subsequently, the user separates the ice bank 300 from the ice-making assembly 10 to take the ice.

Figure 2:
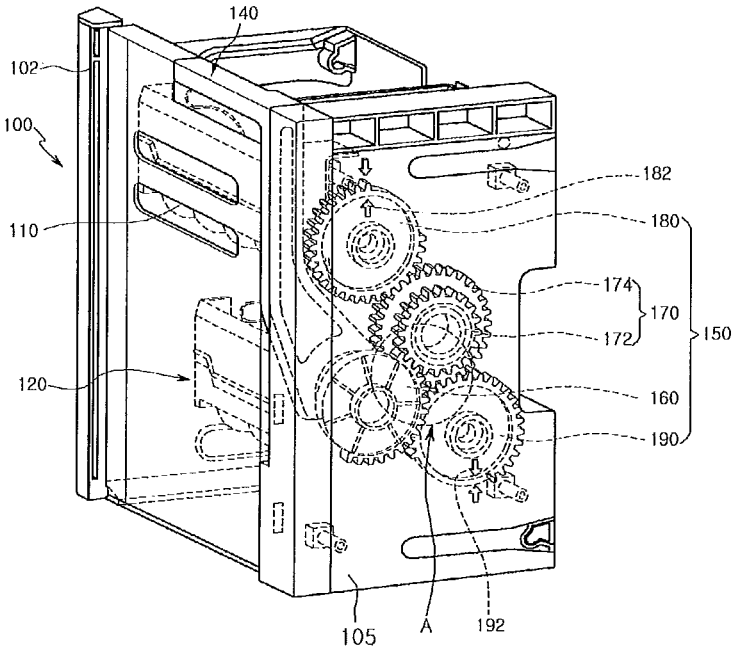
FIG. 2 is a perspective view of an ice-making unit according to an embodiment.

FIG. 2 is a perspective view of the ice-making unit according to an embodiment.

Referring to FIG. 2, the ice-making unit 100 includes an ice-making case 102 defining an exterior thereof, a plurality of trays 110 and 120 rotatably provided on the ice-making case 102, a lever 140 for rotating the trays 110 and 120, and a power transmission assembly 150 for transferring rotational force of the lever 140 to the trays 110 and 120.

The power transmission assembly 150 may be a gear assembly having a plurality of gears engaged with each other. The power transmission assembly 150 is not exposed to an external side by a side cover 105 of the ice-making case 102.

In more detail, the trays 110 and 120 may be respectively referred to as upper and lower trays that are disposed up and down.

The upper and lower trays 110 and 120 are provided with respective rotational shafts (not shown) providing respective rotational centers of the trays 110 and 120. The ice made in the trays 110 and 120 are separated as the trays 110 and 120 rotate.

Meanwhile, the rotational shaft of the lower tray 120 is horizontally spaced apart from the rotational shaft of the upper tray 110 by a predetermined distance so as to prevent the ice of the upper tray 110 from falling to the lower tray 120 during the separation of the ice.

In this case, the ice separated from the upper tray 110 can fall into the ice bank 300 without conflicting with the lower tray 120.

In addition, the lever is rotatably coupled to a side surface of the ice-making case 102. The lever 140 is exposed to an external side so that the user can easily manipulate the same.

The rotational force generated by the lever 140 is transferred to the upper tray 110 and the lower tray 120 by the power transmission assembly 150. The trays 110 and 120 may be designed to rotate in a same direction as the lever 140.

The following will describe the power transmission assembly 150 in more detail.

The power transmission assembly 150 includes a driving gear 160 that is connected to the lever 140 to rotate together with the rotation of the lever 140, a connecting gear 170 that is engaged with the driving gear 160 to rotate by the driving gear 160, and driven gears 180 and 190 that are engaged with the connecting gear 170 and coupled to the respective rotational shafts of the trays 110 and 120.

In more detail, the driving gear 160 is connected to a side of the lever 140. When the lever is pulled, the driving gear 160 rotates in a same direction as the lever 140.

In addition, the connecting gear 170 includes a small gear engaged with the driving gear 160 and a large gear 174 having a same rotational shaft as the small gear 172.

The large gear 174 is engaged with the driven gears 180 and 190.

The driven gears 180 and 190 may be respectively referred to as an upper driven gear disposed above the large gear 174 and a lower driven gear located under the large gear 174.

Therefore, when the large gear rotates, the upper and lower driven gears 180 and 190 rotates together with the large gear 174.

Further, the connecting gear 170 and the driven gears 180 and 190 are coupled to the ice-making case 102.

The following will describe the operation of the lever 140 and power transmission assembly 150.

When the lever 140 is pulled, the driving gear 160 rotates in a direction, i.e., in a counter clockwise direction in FIG. 2. Then, the small gear 172 engaged with the driving gear 160 rotates clockwise.

In addition, the large gear 174 rotates in a same direction as the small gear 172.

As the large gear 174 rotates clockwise, the upper driven gear 180 and the lower driven gear 190 rotate counterclockwise.

That is, when the connecting gear 170 rotates clockwise, the driven gears 180 and 190 rotate in a same direction (i.e., counterclockwise direction) as the driving gear 160 by the large gear 174.

Here, although the direction is described with reference to FIG. 2, the direction may be varied depending on a direction looking the power transmission assembly 150.

The structure of the power transmission assembly 150 will be described in more detail with reference to the accompanying drawings.

Figure 3:
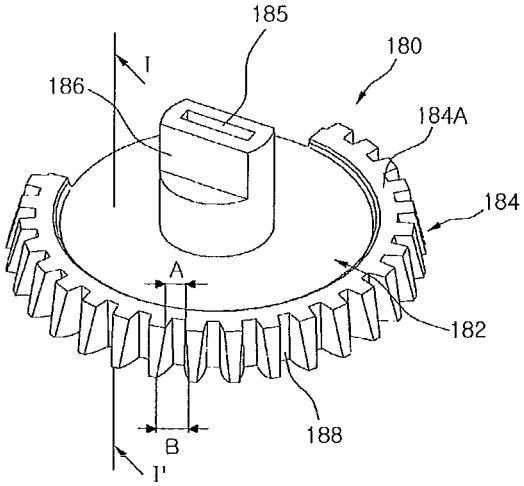
FIG. 3 is a perspective view of a power transmission assembly according to an embodiment.
Figure 4:
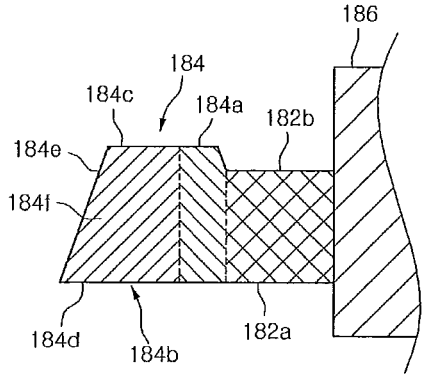
FIG. 4 is a cross-sectional view taken along line I-I' of FIG. 3.
Figure 5:
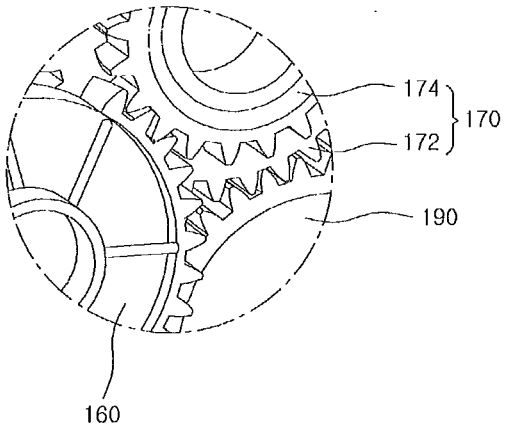
FIG. 5 is an enlarged perspective view illustrating a portion A of FIG. 2.

FIG. 3 is a perspective view of the power transmission assembly according, FIG. 4 is a cross-sectional view taken along line I-I' of FIG. 3, and FIG. 5 is an enlarged perspective view illustrating a portion A of FIG. 2.

For the descriptive convenience, the description will be done with reference to the upper driven gear 180. The shape of the driven gear 180 may be identically applied to the other gears, e.g., the lower driven gear 190, the driving gear 160, and the connecting gear 170.

The upper driven gear 180 includes a body unit 182 defining an exterior thereof, a coupling portion 186 that is formed on a surface of the body 182 and coupled to the tray 110, and a plurality of teeth 184 protruding outward along an outer circumference of the body unit 182.

In more detail, the body unit 182 includes a front surface portion 182*a* defining a front surface of the upper driven gear 180 and a rear surface portion 182*b* defining a rear surface of the upper driven gear 180. In FIG. 3, a portion defining the top surface of the body unit 182 corresponds to the rear surface portion 182*b*.

In addition, the coupling portion 186 is formed on the front portion 182*b* of the body unit 182.

The coupling portion 186 may be integrally formed with the body unit 182. The upper driven gear 180 is connected to the rotational shaft of the tray 110 by the coupling portion 186.

On the other hand, the lower driven gear 190 is connected to the rotational shaft of the tray 120 by the coupling portion 186.

In more detail, the coupling portion 186 protrudes in a direction from a central portion of the rear surface portion 182*b*. In addition, the coupling portion 186 is provided with a tray connecting groove 185 in which the rotational shaft of the tray 110 can be inserted.

The tray connecting groove 185 is formed to correspond to a shape of the rotational shaft of the tray 110.

Meanwhile, the gear teeth 184 include a teeth body 184*a* formed along an outer circumference of the body unit 182 and protrusions 184*b* protruding outward from the teeth body 184*a*.

In more detail, the protrusion 184*b* includes an upper end portion 184*c* extending outward from an upper end of the teeth body 184*a* and a lower end portion 184*d* extending outward from a lower end of the teeth body 184*a*, and an inclined surface 184*e* defining an outer surface of the protrusion 184*b* and connecting the upper end portion 184*c* to the lower end portion 184*d*.

The teeth body 184*a* has a uniform thickness along the outer circumference of the body unit 182.

The upper end portion 184*c* is formed on a side of the rear surface portion 182*b* and the lower end portion 184*d* is formed on a side of the front surface portion 182*a*.

The lower end portion 184*d* is longer than the upper end portion 184*c*. That is, the lower end portion 184*d* is longer than the upper end portion 184*c* protruding from the teeth body 184*a*.

That is, an end portion of the gear tooth 184 is inclined from the front surface portion 182*a* toward the rear surface portion 182*b* in a teeth body direction.

Accordingly, the inclined surface 184*e* is inclined from the lower end portion 184*d* toward the upper end portion 184*c* in the body portion direction.

That is, a lower portion of the teeth body 184*a* is deeper than an upper portion of the teeth body 184*a*.

Further, the protrusion 184*b* includes a guide surface 184*f* through which foreign substances or frozen ice is removed and discharged. Here, the guide surface 184*f* is referred to as a side surface of the protrusion 184*b*, which extends from the upper end portion 184*c* to the lower end portion 184*d*.

That is, even when foreign substances or ice is inserted between the gear teeth 184, the foreign substances or ice can be removed along the guide surface 184*d* as the gears operate. At this point, the foreign substances or frozen ice can be removed in a direction from the upper end portion 184*b* to the lower end portion 184*c*.

Meanwhile, a gear groove 188 is formed between the adjacent teeth 184.

The gear groove 188 is formed such that a distance between the upper end portions 184*c* is less than that between the lower end portions 184*d*. That is, a width of the gear groove 188 is increasingly reduced from the lower end portion 184*d* to the upper end portion 184*c*.

Therefore, it can be regarded that the width of the gear groove 188 increases in a direction in which the foreign substances or frozen ice is removed.

Further, a side of the gear groove 188 increases as it goes from the upper end portion 184*c* to the lower end portion 184*d*.

In this case, the foreign substances or ice can be more effectively removed.

As shown in FIG. 3, the gear groove 188 is designed such that the width and depth thereof increases as they go from the rear surface portion 182*b* to the front surface portion 182*a* ("B">"A").

Therefore, an internal size of the gear groove 188 increases from the upper end portion 184*c* to the lower end portion 184*d*.

Here, the portion "A" may be sized such that the tooth of the large gear 174 engaged with the upper driven gear 180 can be inserted. The portion "B" may be larger than the tooth of the large gear 174.

The ice inserted in the portion "A" moves toward the front surface portion 182*a* by the gear tooth 184 during the rotation of the driven gear 180 and the large gear 174 that are engaged with each other, thereby being removed.

Further, a side surface of the gear tooth 184 may be rounded.

Accordingly, it can be prevented that a portion of the teeth body 184*a* (i.e., a root portion of one gear tooth 184) is dug by a side surface of one gear tooth 184 during the rotation of the gears.

The gear teeth 184 may be partly formed on the outer circumference of the body unit 182. That is, the outer circumference of the body unit 182 may not be provided with the gear teeth 184.

Namely, considering the rotational angle of the driven gear 180, only a portion of the body unit 182, which is required to cooperate with the connecting gear 170, is provided with the gear teeth 184.

Although not shown in the drawings, the driving gear 160 and the connecting gear 170 may be also identically designed to the driven gears 180 and 190.

However, a shape of the coupling portion 186, the number of the gear teeth 184, and a diameter of the body unit 182 may be different.

In more detail, the gear teeth are not formed on an entire portion of the outer circumference of the body portions of the driven gears 180 and 190 and driving gear 160 but formed only on portions that are engaged with other gears.

That is, since the driving gear 160 cooperates with the lever 140. There is no need to rotate the lever 140 by 360° but within a predetermined angle range, the gear teeth may be partly formed on the outer circumferences of the driven gears 180 and 190 and the driving gear 160.

The driven gears 180 and 190 rotate to rotate the trays 110 and 120. At this point, there is no need to rotate the trays 110 and 120 by 360° but within the predetermined angle range.

On other hand, since the connecting gear 170 is designed to be fully engaged with the driven gears 180 and 190 and the driving gear 160, the gear teeth 184 are formed on an entire portion of the outer circumference of the body unit. That is, since the connecting gear 170 is designed to rotate by 360°, the gear teeth 184 are entirely formed on the outer circumference of the body unit.

Meanwhile, a mounting location marks 192 are formed on a portion of the ice-making case 102 near a location on which the driven gears 180 and 190 and the driving gear 160 are mounted so that the driven gears 180 and 190 can be accurately mounted.

As shown in FIG. 3, the mounting location marks 192 may be provided in the form of arrows on the driven gears 180 and 190 and the ice-making case 102.

That is, a location where the arrows face each other indicates an accurate mounting location. The power transmission assembly 150 can be easily assembly through the mounting location marks 192.

The following will describe the operation of the ice-making assembly with the power transmission assembly structured as described above.

The water is filled in the water tank 200 through the water supply passage formed in the refrigerator and the water filled in the water tank 200 is supplied to the trays 110 and 120.

When the cool air is supplied to the ice-making unit 100 for a predetermined time, the water filled in the trays 110 and 120 are frozen into ice.

In a state where the water is frozen into the ice, the user rotates the lever 140 in a direction.

At this point, the driving gear 160 connected to the lever 140 rotates in a same direction as the lever.

When the driving gear 160 rotates, the connecting gear 170 engaged with the driving gear 160 rotates in an opposite direction to the driving gear 160.

The connecting gear 170 has an upper portion engaged with the upper driven gear 180 and a lower portion engaged with the lower driven gear 190. Therefore, the driven gears 180 and 190 rotate in an opposite direction to the connecting gear 170, i.e., in a same direction as the driving gear 160.

When the driven gears 180 and 190 are driven, the trays 110 and 120 rotate in a same direction as the driven gears 180 and 190.

The trays 110 and 120 are twisted while rotating, by which the ice frozen in the trays are separated from the trays 110 and 120.

The separated ice falls into the ice bank 300.

Meanwhile, the driving gear 160, connecting gear 170, and driven gears 180 and 190 are designed such that the gear teeth 184 thereof are inclined toward the gear body unit 182 as they go from the front surface portion 182*a* to the rear surface portion 182*b*.

Subsequently, the width defined between the adjacent gear teeth 184 increases from the rear surface portion 182*b* to the front surface portion 182*a*.

Therefore, the foreign substances or ice inserted in the gear groove 188 between the adjacent gear teeth 184, it is removed from the rear surface portion 182*b* to the front surface portion 182*a* along the shape of the gear tooth 184.

That is, as the gears are engaged and rotate, the gear teeth 184 closely contact each other at the rear surface portion 182*b* side or the upper end portion 184*b* side and thus the ice is pushed toward the front surface portion 182*a* having a relatively larger space.

As described above, the ice pushed toward the front surface portion 182*a* cannot stay in the gear groove 188 but is removed to an external side by the rotational vibration of the gears.

By the above-described shape of the gear tooth 184, the power transmission assembly 150 can effectively operate without being interrupted by the foreign substances or frozen ice. Therefore, the force required for rotating the lever of the ice-making unit 100 can be reduced.

Although embodiments have been described with reference to a number of illustrative embodiments thereof, it should be understood that numerous other modifications and embodiments can be devised by those skilled in the art that will fall within the spirit and scope of the principles of this disclosure.

INDUSTRIAL APPLICABILITY

According to the embodiments, even when the water is infiltrated into the power transmission assembly and frozen, the frozen ice can be removed in a direction by the above-described structures of the gears.

Likewise, even when the foreign substances are inserted into the power transmission assembly to conflict with the gear teeth, the foreign substances can be removed in a direction by the above-described structures of the gears.

As the foreign substances or frozen ice can be removed from the power transmission assembly, the power transmission assembly can be more smoothly rotated.

The invention claimed is:

1. An ice-making assembly of a refrigerator, the ice-making assembly comprising:

a case receiving a plurality of ice trays;

a lever provided at the case and operable to rotate the ice trays;

a driving gear connected to the lever to be rotatable according to rotation of the lever;

a plurality of driven gears engaged with the driving gear, one of the driven gears comprising:

a body unit provided with a front surface portion, a rear surface portion being opposite to the front surface portion and a coupling portion provided on the body unit to be coupled to one of ice trays; and a plurality of gear teeth protruding from an outer circumference of the body unit, each of the gear teeth comprising:

a first surface extending radially outwardly relative to the body unit;

a second surface extending radially outwardly relative to the body unit; and an inclined surface connecting an end of the first surface with an end of the second surface and being inclined to a rotational axis of the driven gear.

2. The ice-making assembly according to claim 1, wherein a gear groove extends between the first surface and the second surface is formed between adjacent gear teeth.

3. The ice-making assembly according to claim 2, wherein a size of the gear groove increases from the second surface to the first surface.

4. The ice-making assembly according to claim 2, wherein distances between second surfaces of the adjacent gear teeth are greater than distances between first surfaces of the adjacent gear teeth.

5. The ice-making assembly according to claim 2, wherein a depth of the gear groove at the first surface is greater than a depth at the second surface.

6. The ice-making assembly according to claim 2, wherein a width of the gear groove at the first surface is greater than a width at the second surface.

7. The ice-making assembly according to claim 1, wherein the inclined surface comprises a guide surface for discharging foreign substances or ice.

8. The ice-making assembly according to claim 3, further comprising a connecting gear intermeshed with the driving gear, the driven gears being intermeshed with the connecting gear.

9. The ice-making assembly according to claim 8, wherein a size of the gear groove at the second surface corresponds to a size of gear teeth of the connecting gear, and wherein a size of the gear groove at the first surface is bigger than a size of the gear teeth of the connecting gear.

10. The ice-making assembly according to claim 8, wherein the gear teeth of the driven gears are formed only on a portion of an outer circumference of the body unit.

11. The ice-making assembly according to claim 1, wherein the case comprises a mounting location mark to guide mounting of the driven gears.

12. The ice-making assembly according to claim 1, wherein the rotation axis of one of the driven gears is approximately parallel to that of the driving gear.

13. The ice-making assembly according to claim 1, wherein the first surface extends from the front surface portion to a direction parallel to the body unit, and the second surface extends from the rear surface portion to a direction parallel to the body unit.

* * * * *